United States Patent [19]

Post

[11] Patent Number: 4,503,647

[45] Date of Patent: Mar. 12, 1985

[54] STRUCTURAL BUILDING ELEMENTS FOR CONSTRUCTION OF SIMULATED LOG HOUSES

[76] Inventor: Gerhard Post, Im Alten Dorfe 24, 2106 Bendestorf, Fed. Rep. of Germany

[21] Appl. No.: 461,550

[22] Filed: Jan. 27, 1983

[30] Foreign Application Priority Data

Feb. 4, 1982 [DE] Fed. Rep. of Germany ..... 3203684

[51] Int. Cl.[3] ..... E04B 1/10

[52] U.S. Cl. ..... 52/233; 52/90

[58] Field of Search ..... 52/233, 90–93; 46/20; 403/346, 347

[56] References Cited

U.S. PATENT DOCUMENTS

| | | | |
|---|---|---|---|
| 1,287,771 | 12/1918 | Schmitt | 46/20 |
| 1,702,340 | 2/1929 | Gates | 52/92 |
| 1,783,383 | 12/1930 | Montrief | 52/91 |
| 2,542,151 | 2/1951 | McAuliffe | 52/93 |
| 3,293,808 | 12/1966 | Duncan | 52/92 |
| 3,308,583 | 3/1967 | Chaney | 52/92 |
| 4,056,906 | 11/1977 | Elfstrom | 52/233 |

FOREIGN PATENT DOCUMENTS

| | | | |
|---|---|---|---|
| 2535980 | 2/1976 | Fed. Rep. of Germany . | |
| 1373787 | 8/1964 | France | 52/233 |

*Primary Examiner*—James L. Ridgill, Jr.
*Attorney, Agent, or Firm*—Thomas H. Whaley

[57] ABSTRACT

The invention relates to structural building elements suitable for construction of a log house made of wall boards (47) placed on top of each other and joined to one another so as to form the walls (59) of the house and to building structures formed from said building elements. Wall boards (47) are retained in grooves of corner support members and, if desired, of additional intermediate support members which are formed of corner support elements (1, 50) placed on top of one another. The thickness of the wall boards (47) is less than that of the freely outwardly projecting head pieces (9) of the support elements (1, 50). Two respective corner support elements (1) are topwise and crossingly joined in interengaging relationship to form a joint assembly. Multinotched stacking profiles (27, 29), which interdigitate firmly, stabilize the stacked joint assemblies.

5 Claims, 11 Drawing Figures

Figure 4:
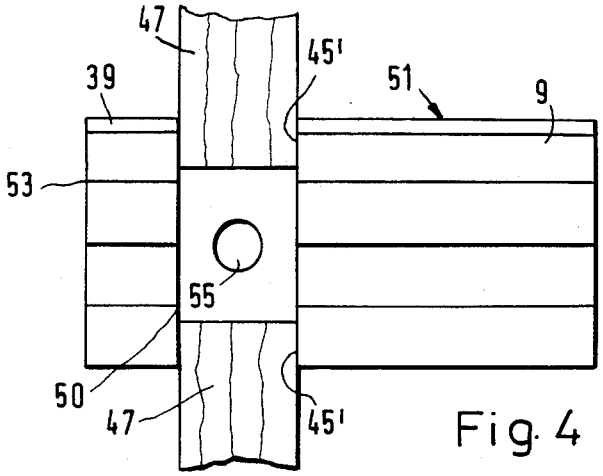

Fig.1
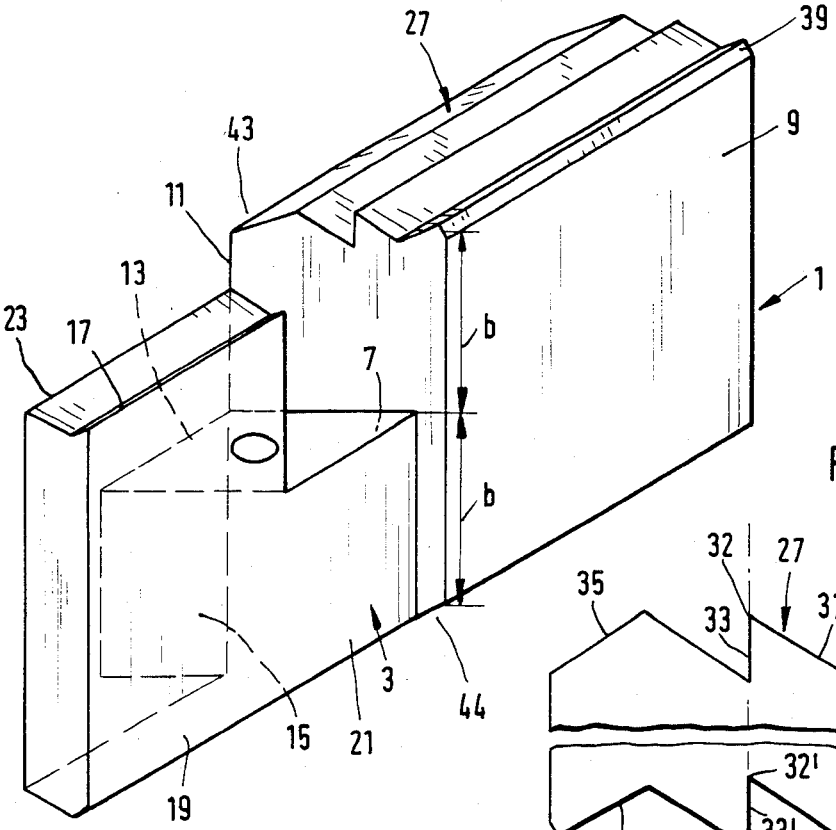
Fig. 2
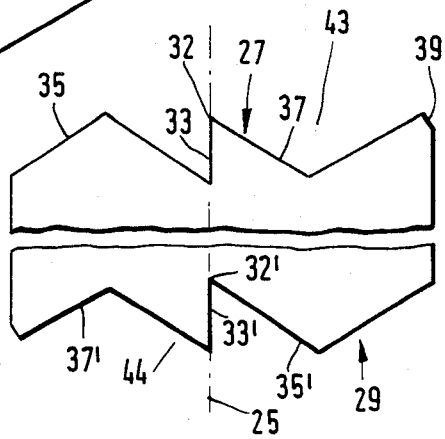
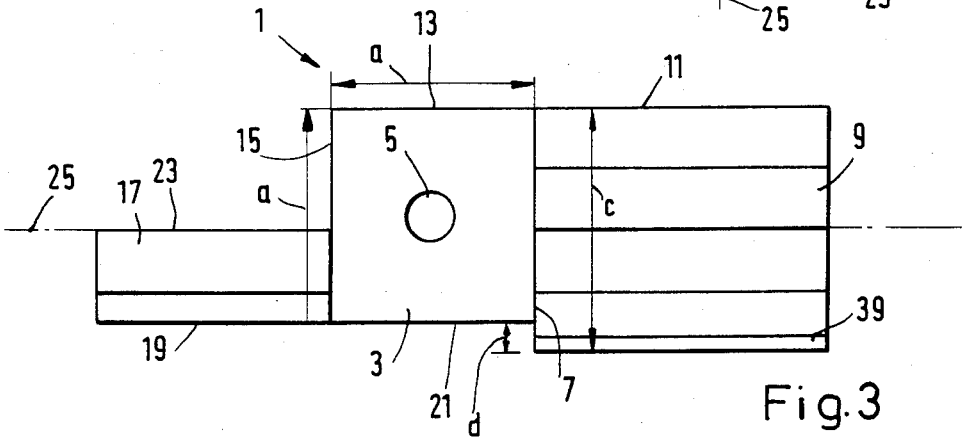
Fig.3

STRUCTURAL BUILDING ELEMENTS FOR CONSTRUCTION OF SIMULATED LOG HOUSES

The invention relates to a log house comprising wall boards placed upon each other and forming the walls of the house, and corner support members forming the corners of the house and assembled from cross-wise corner support elements stacked upon one another, each corner support element consisting of a free-ended, projecting head piece and an inwardly disposed joint member which are formed with such a profile that crossing corner support elements form grooves for accommodating inserted wall boards of smaller thickness.

Initially, log houses were built from solid planks which were placed upon each other and joined to form the individual walls of the house. A typical feature of such log houses are plank head pieces which project from the corners of the house and have free ends.

Such log houses are extremely solid. A drawback of such log houses is the high material requirement. Unskilled persons cannot set up such log houses.

From the DE-AS No. 2,535,980 a double-shell wall structure for log houses has been known. The walls are formed of boards with insulating material sandwiched therebetween. The corner supports are formed by vertically extending timber battens which define a hollow space or shaft. The walls are mounted on the corner support members. The head pieces are mounted on the corner support members by means of pins and are mere dummies which might be dispensed with, because they have no structural function.

The U.S. Pat. No. 4,056,906 shows a further corner support structure for log houses. Here the head pieces are provided with joint elements which extend into the joint region of the corner support members. The corner support elements, which are formed of the plank head pieces and the joint elements, are successively laid upon one another at a respective offset of 90 degrees. Such a corner support member is rather loosely joined, thus requiring a large weight of the individual corner support elements. The but slightly bent stacking profiles result in an unsatisfactory mutual guiding.

In one embodiment the wall boards engage with undercut tenons in the joint region of the corner support member. This mortise and tenon joint is expensive and does not permit erection of the house from wall board lengths that may be cut by unskilled persons. The assembly requires much skill. In a further embodiment chamfered wall boards are fastened between the head piece and a butt end of a joint, however, a matched chamfer again requires some skill.

It is the object of the present invention to provide a log house in which the wall boards may be cut straight to the desired lengths by unskilled persons and in which the corner support members, which are formed of support elements stacked upon one another, are securely joined irrespective of the weight of the single corner support elements.

In accordance with the present invention the above-specified object is solved in that:

the corner support elements of the corner support member are formed with uniform longitudinally extending multi-notched stacking profiles, two respective corner support elements, which are disposed in topwise cogging relationship and crosswise interengagement, are joined to form a joint assembly, the profiles of the joint assemblies are in positive interdigitating engagement with joint assemblies disposed thereabove and therebeneath, the joint member consists of a heart quoin having at most half the height of the corner support element and having a guide strap having fully the height of the corner support element, wherein the grooves between the head pieces and the guide straps are configured as straight slide-in grooves, the guide straps provide for an inwardly disposed large-area engagement and abutting surface for the wall boards.

The corner support members of the above log house are stable solely due to the stacking of the corner support elements on top of one another. This is due to the fact that two respective crossing corner support elements are combined in such a manner as to form a cogging joint. Thus these two corner support elements form a strong joint assembly. The individual joint assemblies are then stacked upon one another, wherein the upper and lower stacking profiles are in positive engagement and firmly interdigitate. As the wall boards engage linearly in the grooves formed during assembly of the corner support member, they may be cut to the desired length by every unskilled person. Thus, the unskilled person may himself determine the ground plan and size of his log house. The wall boards can always be reliably secured, because they are in large-area engagement with the guide straps.

Storage and assembly of the support members are greatly facilitated by the fact that all support elements are identical and have the same uniform profile.

In accordance with a further embodiment of the invention the profiled shape of the corner support elements is such that:

the central heart quoin has identical horizontal side lengths, the head piece, which unilaterally projects beyond the heart quoin by at least twice the height of the latter, is contiguous with a vertical quoin face, the horizontal width of the head piece is greater than a horizontal quoin side length, wherein the head piece unilaterally projects horizontally beyond the heart quoin, the guide strap is contiguous with the quoin face which is remote from the quoin face carrying the head piece, and projects beyond the heart quoin on the same side as the head piece to the same height as the latter, the guide strap is contiguous with the heart quoin at a vertical longitudinal face lying in the common vertical central plane of heart quoin and head piece, whereas the other vertical longitudinal face on the side of the head piece projection either lies in the plane of the vertical quoin face disposed on this side or is somewhat cut away relative to the longitudinal face towards the central plane.

There may be cases when a lighter corner support structure is desirable. This may be the case when such a corner support member is to be set up in the interior of the house or when a heavy corner support structure can be dispensed with due to smaller dimensions of the house. For such applications the invention provides that:

simple support elements of the corner support member are formed with uniform longitudinally extending multi-notched stacking profiles, two respective ones of these simple support elements, which are disposed in topwise cogging relationship and cross-wise interengagement, are joined to form a joint assembly, the profiles of the joint assemblies of the corner support member are in positive interdigitating engagement with joint assemblies disposed thereabove and therebeneath, the joint member consists of a guide strap at the level of the head piece and formed with a cutout extending over about half its height, said guide strap after cogging with the guide strap of another simple support element defining in the joint assembly between itself and the head piece of the other simple support element of said joint assembly the straight grooves for accommodating the wall boards, the guide straps form an inwardly disposed, large-area engagement and supporting surface for the wall boards.

This simple corner support member also, due to the structure of its simple support elements, in itself forms a firm joint, because two respective simple support elements are securely joined because of their cogging relationship, and positive profile engagements firmly interdigitate the individual joint assemblies towards the top and bottom. The guide straps and the wall boards are in large-area engagement with one another.

In accordance with a further embodiment of the invention the simple support elements are so designed that the one vertical longitudinal face of the guide straps extends in the plane of a vertical longitudinal face of the head piece, and the other vertical longitudinal face of the guide strap extends in parallel therewith at a distance which is smaller that the horizontal thickness of the head piece.

Since two respective corner support elements are employed which are alternately combined in topwise cogging relationship, it is necessary to provide for a joining or a tongue-and-groove joint in which the positive profile engagement is always ensured on assembly. In order to realize this, it is provided that the horizontal end faces, i.e., the top and the bottom of each support element, are formed with a cross-sectional profile which comprises an approximately vertical cutting face lying in the vertical central plane, a V-profile being adjacent the outer end edge thereof and a symmetrical saddleback roof profile being adjacent the inner end edge thereof. Upon assembly, saddleback roof profiles will always meet V-notch profiles so that a reliable joint will be formed.

It may be that the length of the sidewalls of the log house is greater than the length of a wall board. According to a further development the invention is therefore characterized by:

intermediate support elements which between an outer head piece and an inner abutment are formed with grooves for receiving the wall boards, uniform intermediate support elements disposed upon one another in positive profile engagement.

The rafters, too, should be readily set up in an easily assembled house. Therefore a special rafter retaining means is provided in the case of a log house having a saddleback roof whose rafters rest on the upper sides of the topmost wall planks. In accordance with a further embodiment of the invention said rafter retaining means is characterized by forked props placed in pairs on the inside and the outside onto the upper edges of the topmost wall boards and securing the rafters with their fork tines. In this way the rafters are reliably guided and rest with a large area thereof on the forked props.

Figure 5:
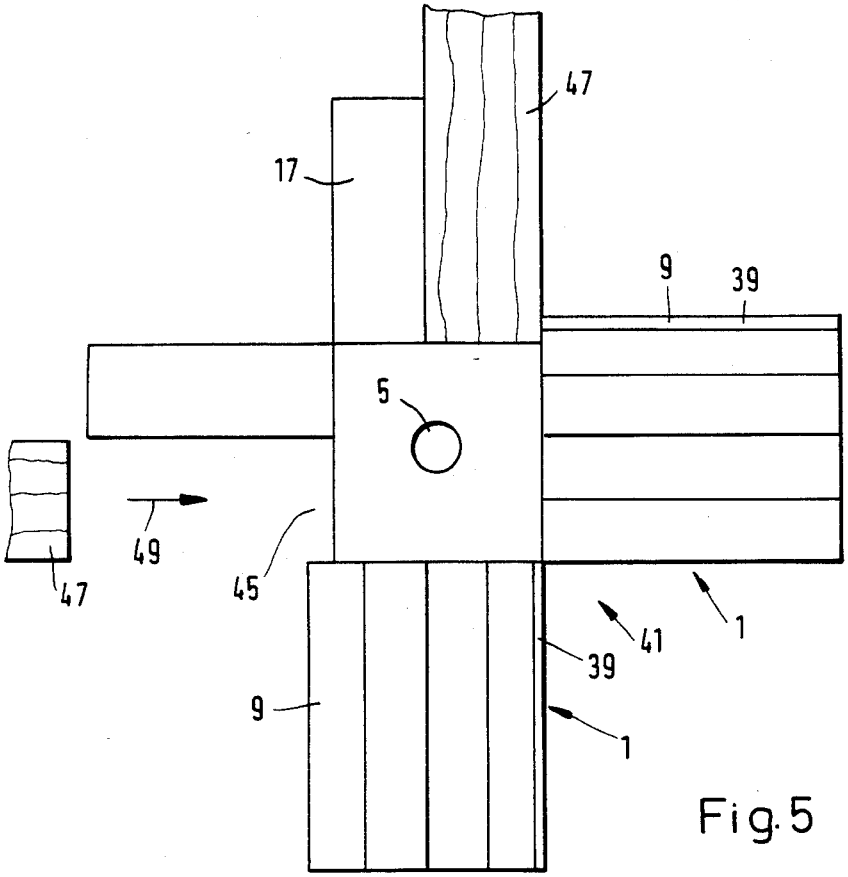
Figure 6:
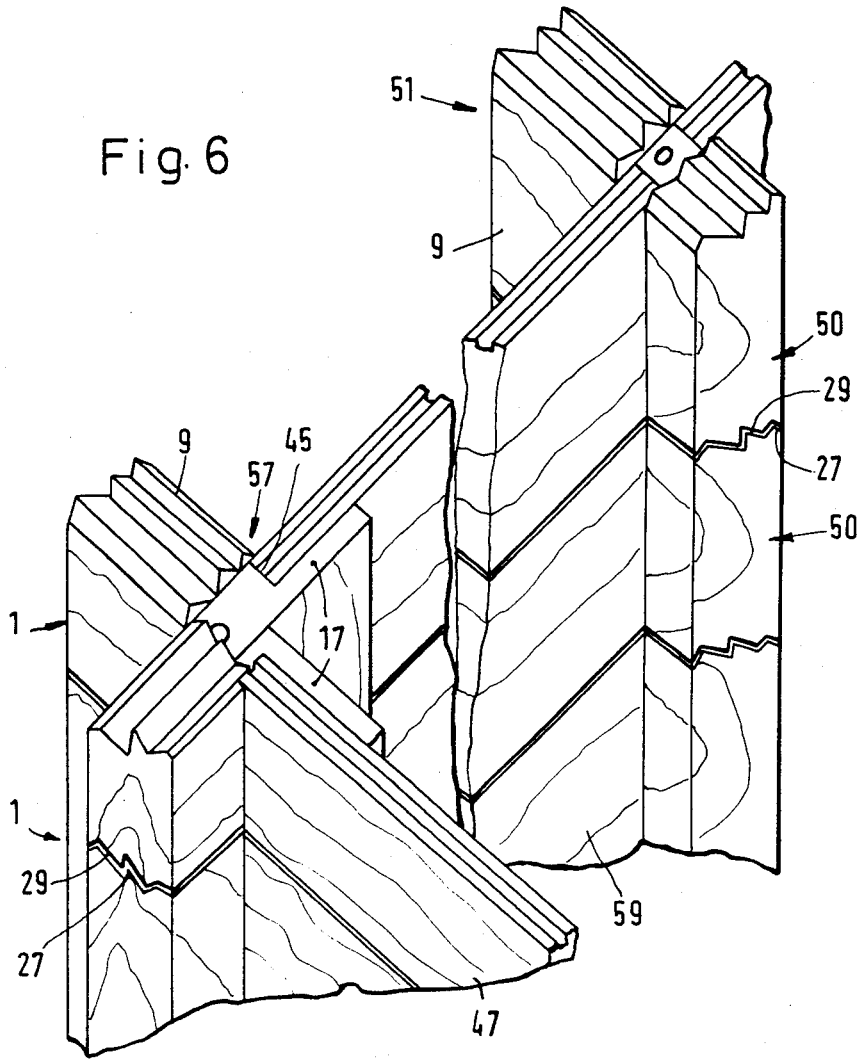
Figure 7:
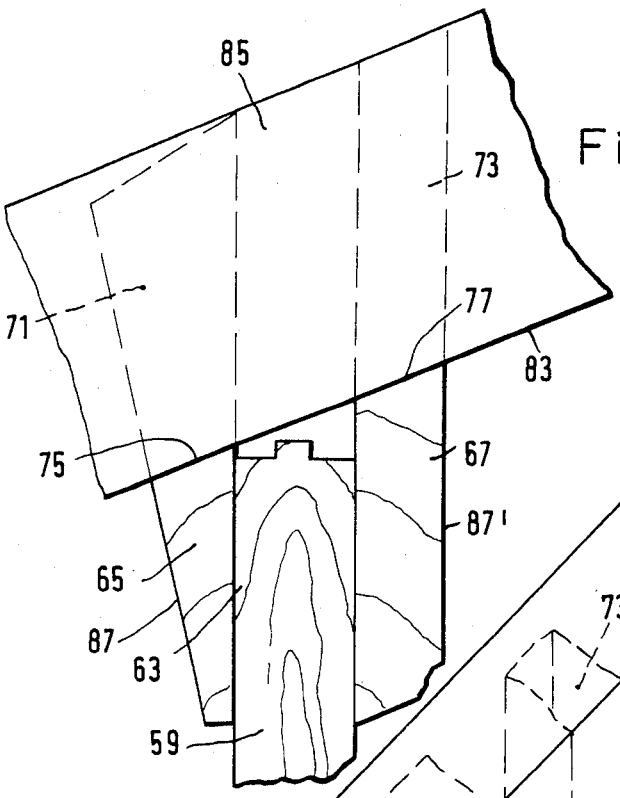
Figure 8:
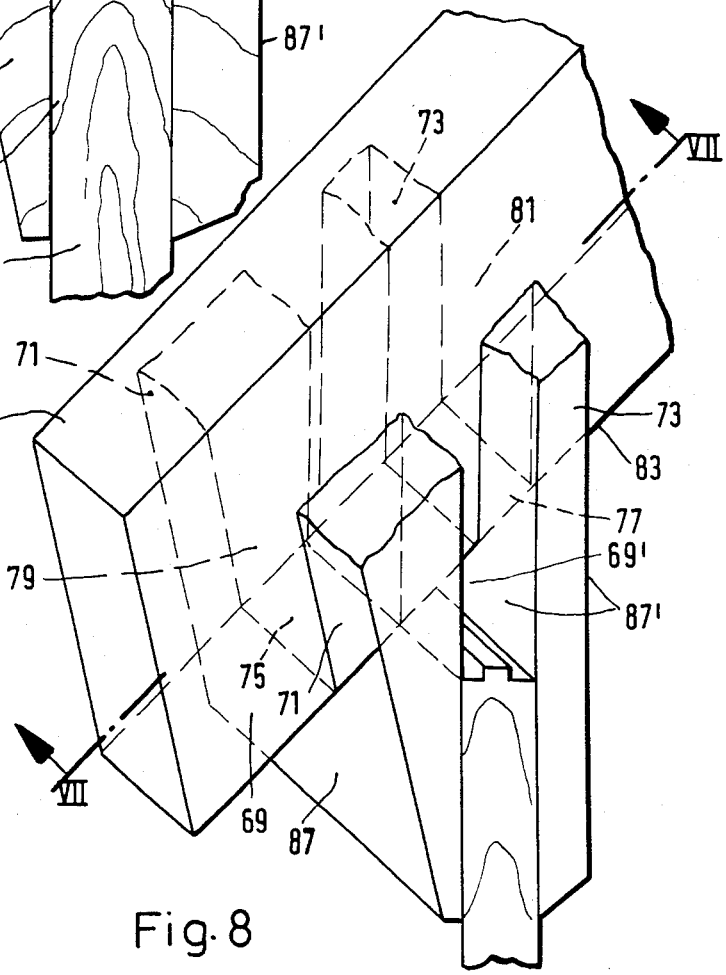
Figure 9:
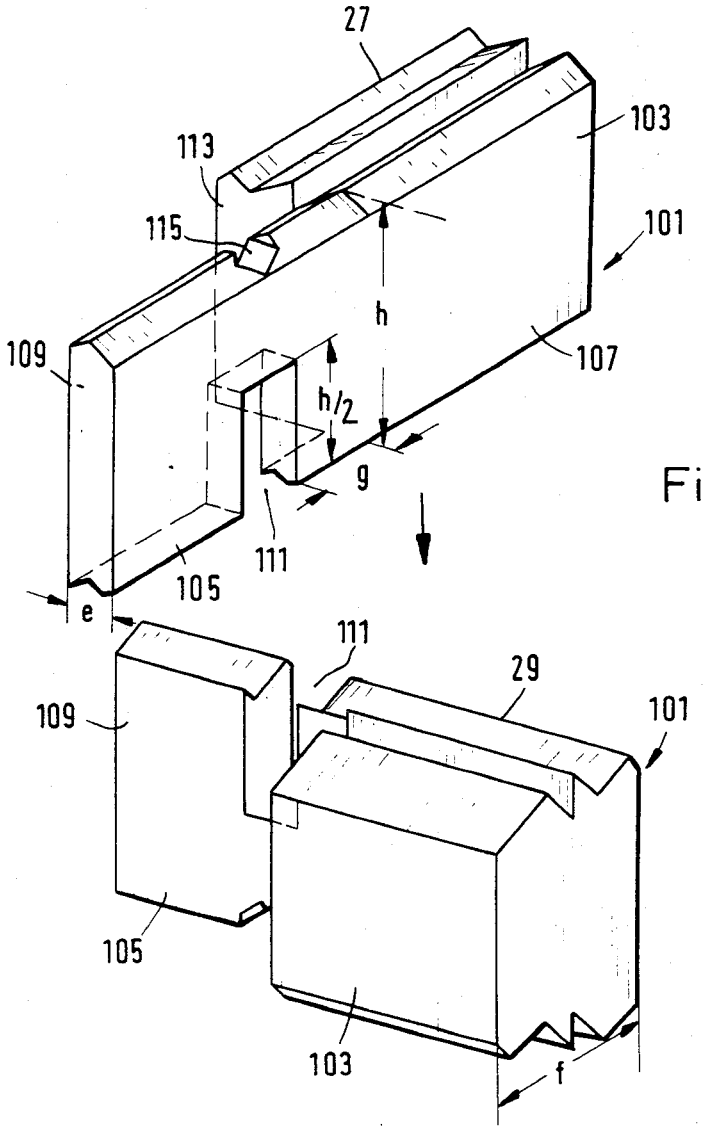
Figure 10:
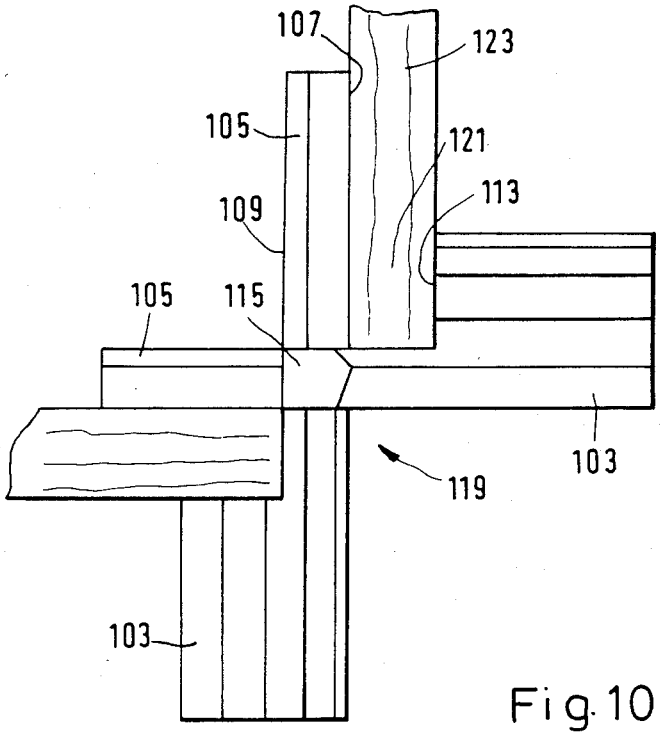
Figure 11:
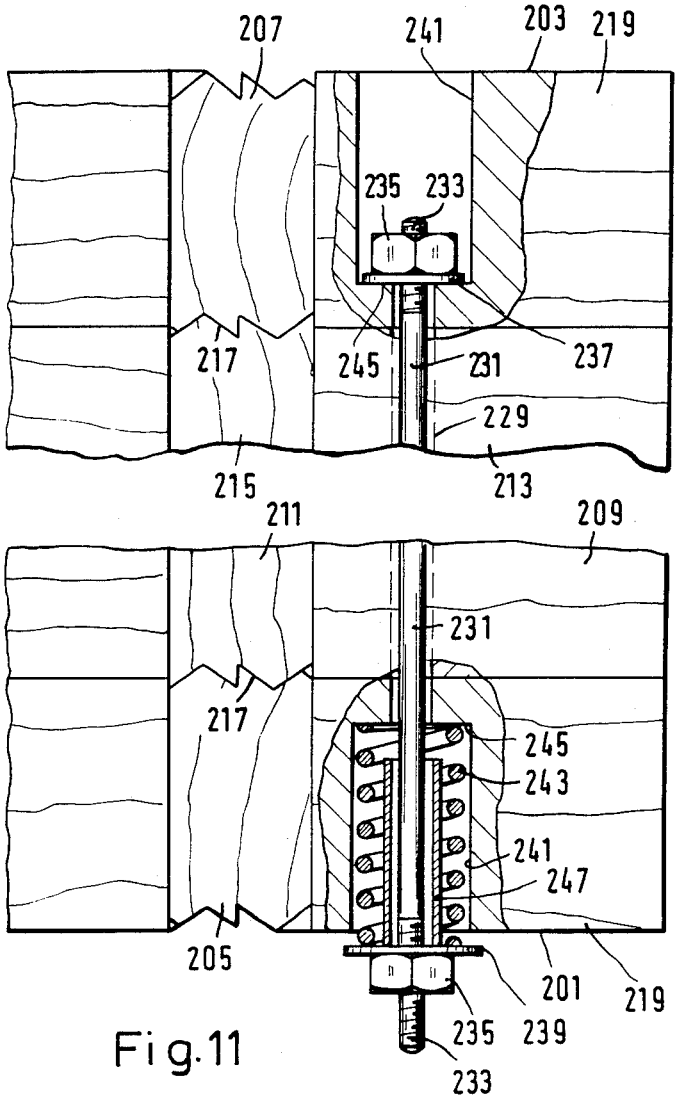

The invention will be explained in detail with reference to the embodiment thereof as shown in the drawing, in which:

FIG. 1 shows a corner support element from which the corner support members for the log house are assembled, FIG. 2 shows a cross-sectional profile for the top and bottom end faces of the corner support element, FIG. 3 is a plan view of the corner support element of FIG. 1, FIG. 4 shows an intermediate support element of an intermediate support member, FIG. 5 shows two corner support elements assembled to form a corner-plank cross, FIG. 6 is a diagrammatic view of a house corner and a house wall with an intermediate support member as a combination of the embodiment according to the FIGS. 4 and 5, FIGS. 7 and 8 are a sectional and a diagrammatic view respectively, of the mounting of rafters on the house walls by means of forked props, FIG. 9 shows two simple support elements of a different design, which are to be mounted in cogging relationship to form a joint assembly, FIG. 10 is a plan view of two simple support elements forming a joint assembly, FIG. 11 show the topmost and the lowermost timber of a corner support member of a log house including a tie rod according to the invention, which is shown in section in the partially sectioned timbers.

In the log house, the corner posts consists of individual corner support members defining grooves for receiving the wall boards. When joined to each other, these wall boards form the walls of the house. The thickness of the wall boards is preferably less than half the thickness of the head pieces. It is preferred to use wall boards of a thickness which is a quarter of the thickness at the head pieces. The plank thickness within the meaning of the invention relates to timber planks having a thickness of about 40 mm and more. Accordingly, the wall boards of similar height have a thickness of somewhat less than 30 mm, preferably of 28 mm and less.

The corner support members, for instance for the outer walls, are assembled from individual corner support elements shown in FIG. 1 and all of them having the same profile or shape as shown in FIG. 1. For a better illustration, FIG. 2 shows the top and bottom profiles of the corner support elements, while FIG. 3 is a plan view of the corner support element according to FIG. 1.

The corner support element 1 according to FIGS. 1 to 3 comprises in its joint region a central heart quoin 3. As is particularly apparent from FIG. 3, said heart quoin 3 has identical lateral dimensions a in the horizontal direction and identical lateral dimensions b in the vertical direction. A vertical bore 5 for a tie rod (not shown) extends through the wood of the heart quoin 3. A head piece 9 is contiguous with a vertical side face 7 of the heart quoin 3 disposed in the joint region. In horizontal direction the head piece 9 has a width c which is larger than the horizontal length a of the quoin. A side face 11 of the head piece lies in the same plane as a quoin face 13 adjoining the quoin connecting face 7. Thus the head piece 9 horizontally extends on one side beyond the heart quoin 3 by the distance d. In vertical direction the head piece 9 is also longer than the length b of the heart quoin 3. In order to allow for a tight stacking of the corner support elements 1, the projecting height also corresponds to b. In vertical direction also the head piece 9 projects unilaterally—when viewing the position of FIG. 1—upwards beyond the heart quoin 3. The material of the heart quoin 3 may be slightly removed at the bottom as indicated in FIG. 1, whereby stacking is facilitated.

A guide strap 17 is provided adjacent that quoin face 15 which is remote from the connecting face 7 of the head piece 9. The length of said guide strap may essentially be as desired, which also applies to the head piece 9. The vertical height of the guide strap 17 corresponds to the height of the head piece 9; however, in horizontal direction it is narrower. In the same way that the long face 11 of the head piece 9 is in the same plane as the adjoining quoin face 13, a long face 19 of the guide strap 17 is in the same plane as an opposite quoin face 13. The other long face 23 of the guide strap 17 lies in a vertical central plane 25 of the corner support element 1.

FIG. 2 shows the multi-notched profile 27 of the top 43 of the corner support element 1 and the multi-notched profile 29 of the bottom 44 of the corner support element 1 according to FIG. 1. An outer edge 32 and an inner edge 32' of undercut faces 33 and 33' lie in the the vertical central plane 25. The top profile 27 comprises a roof-shaped profile 35 to the left of the undercut face 33 and a V-shaped profile 37 to the right thereof. The outer side of the V-shaped profile is further formed with a chamfer 39. The shape of the bottom profile 29 corresponds to that of the top profile 27. Thus there results in FIG. 2 to the left of the central plane 25 a V-shaped profile 37' and to the right thereof a roof-shaped profile 35'. Of course, "to the left" and "to the right" of the central plane 25 depends on the direction of view. The left-hand and the right-hand design are also interchangeable. When the individual support elements are placed upon one another there will always result mutual clawing or interdigitation of the individual profiles.

FIG. 5 shows how two corner support elements 1 form a joint assembly 41. This joint assembly is formed by fitting the tops 43 of two corner support elements 1 into each other. Thereupon linear grooves 45 are respectively formed between the head pieces 9 and the guide straps 17. These grooves have exactly the width of wall boards 47 which are inserted into the grooves 45 in the direction of an arrow 49. The left side of FIG. 5 shows the insertion process, whereas this has already been terminated at the top portion of FIG. 5. The wall boards 47, to which the guide straps 17 adjoin over a large area, may be fixed to the guide straps 17 by means of nails or bolts. In the embodiment shown, the width of the wall boards 47 is equal to half the width of the head pieces 9. By enlarging the distance d (FIG. 3) the width c of the head piece 9 may also be increased as desired. For reasons of expedience the width of the wall boards 47 will at most amount to half the width c or, preferably, even less. Of course, the length of the head piece 9 may be as desired by the designer.

FIG. 4 is a plan view of an intermediate support element 50 of an intermediate support member 51. The intermediate support elements 50 consist of plank lengths of the thickness of a head piece, which are formed between a head piece 9 and an internal abutment 53 with grooves 45' for receiving the wall boards 47. The head pieces 9 correspond fully to the head pieces 9 according to the FIGS. 1, 3 and 5. A vertical bore 55 may extend through the grooved region of the intermediate support elements 50, through which bore a tie rod (not shown) may be passed. Wall boards 47 are inserted into the grooves 45'. In this way it is possible to extend a wall.

FIG. 6 is a diagrammatic view of FIGS. 4 and 5 together, in which, however, a different corner of the house with corner support member 57 and house wall 59 has been chosen. It is apparent from the building corner in what manner joint assemblies 41 of interfitted corner support elements 1 are stacked with their bottoms 44 onto the tops 43 of other joint assemblies 41. It is clearly apparent that the profiles 27 and 29 are pushed into each other. The wall boards 47 may be formed with grooves and tongues in the usual manner.

Likewise, FIG. 6 shows intermediate support elements 50 which form the intermediate support member 51 and are stacked upon one another. The profiles 27 and 29 of these intermediate support elements 50 fit into one another. As is clearly apparent from FIG. 6, the thickness of the outwardly projecting head pieces 9 indicates a solid construction, whereas the sidewalls 59, which are formed of the thinner wall boards 47, are clearly of thinner material; however, this is not visible.

FIGS. 7 and 8 show the assembly of the rafters on the upper ends 63 of the house walls 59. On the outside and the inside forked props 65 and 67 are mounted on the upper house wall regions 63 by means of nails or bolts. As is clearly apparent from FIG. 8, these forked props consist of a lower transverse member 69 and 69', respectively and of fork prongs 71 and 73, respectively. The bottom faces 75 and 77 of the recesses 79 and 81 of the forked props 65 and 67, respectively, are designed as planes which are inclined relative to the horizontal and on which the bottom face 83 of a rafter 85 may rest. In this manner the rafters are reliably secured to the house walls 59. The outer walls 87 and 87' of the forked props 65 and 67, respectively, may either extend in parallel to the house wall as shown in the case of the forked prop 67, or they may be cut to taper away relative to the vertical house wall, as shown in the case of the forked prop 65. The forked props 65 and 67 are always disposed in pairs on the inside and the outside and thus reliably accommodate the load of the roof in a particularly simple manner.

FIGS. 9 and 10 show a modification of the corner support element 1 according to the FIGS. 1 to 6 with the object of realizing the design principle also in case of a lighter structure. A simpler lightweight support member is assembled from the individual simple support elements 101 shown in FIG. 9 and all having the same shape.

The simple support element 101 comprises a head piece 103 which may be designed in accordance with the head piece of FIGS. 1 to 6. Contiguous with the head piece 103 there is provided in longitudinal direction a joint member in the form of a guide strap 105. The guide strap 105 is formed by machining a piece of material having the overall length of the simple support element 101 and having profiles in accordance with FIG. 2, from one side thereof until the guide strap 105 alone remains. Therefore one side face of the guide strap 105 is smoothly contiguous with the one long face 107 of the head piece 103 in the same plane therewith. The guide strap has a thickness e which attains at most half the thickness f of the head piece 103. The long face 109 of the guide strap 105 not visible in FIG. 9 extends in parallel to the face 107.

In FIG. 9 the guide strap 105 is formed with a cutout 111 in the bottom which extends transversely to the longitudinal direction of the simple support element and which has a width that is somewhat larger than the thickness e of the guide strap 105. The distance of the cutout 111 from the inner wall 113 of the head piece 103, which remains after the machining operation, corresponds to the thickness g of a wall board to be inserted. The depth of the cutout 111 corresponds to half the height h of the head piece 103 and of the guide strap 105. From the top a recess 115 is formed in the guide strap 105 in the area of the cutout 111 so as to facilitate the interfitting of joint assemblies 119 stacked above one another.

FIG. 9 shows two simple support elements 101 of which the bottom one is upside down. When the two simple support elements 101 are interfitted and brought into cogging relationship in these relative positions in the direction of an arrow 117, a joint assembly 119 shown in FIG. 10 will be formed. This joint assembly 119 has an inherently extremely solid structure which has a stabilizing effect on a corner support. Between the inner faces 113 of the head pieces and the long faces 109 of the guide straps 105 grooves 121 are defined which receive the wall boards 123 inserted therein. The grooves 123 are straight and permit the accommodation of smoothly cut wall board ends. The wall boards 123 are mounted by nailing or screwing down to the guide straps 105 which engage them over a large area. Corner support members of the simpler type are formed by stacking a plurality of joint assemblies 119 on top of each other. The individual joint assemblies 119 are in positive and thus reliable profile engagement on top of each other, because the corner elements 101 and the joint assemblies 119, respectively, are formed on the top and bottom faces with profiles corresponding to those of FIG. 2. These profiles result in an interdigitation the stacked joint assemblies 119. In this connection, the V-shape 37 and the roof shape 35 of the profiles according to FIG. 2 may be interchanged from left to right; however, this must then be done uniformly with all simple support elements 101 of an employed set.

The simple support element 101 is mainly intended for light structures which will be used in the interior of a house. However, it is quite well suited for the outer corners of log houses.

FIG. 11 shows the top and bottom timbers of a corner support member. The intermediate part of the member is broken away. The topmost and lowermost timbers consist of corner support elements 201 and 203 as well as 205 and 207. The corner support elements 201, 203 and 205, 207 together form topwise interfitted cross joints.

The corner support elements 209, 211, 213, 215, which are adjacent the top corner support elements 203 and 207 and the bottom corner support elements 201 and 205, also form layers of cross joints which on account of their multi-notched stacked profiles 217 interdigitate with the adjacent corner support elements 201, 205 and 203, 207 respectively.

Each corner support element consists of a head piece 219 and joint pieces. These joint pieces are formed by a heart quoin 221 and a guide strap 223. When two respective corner support elements are interfitted to form a cross joint layer, grooves 225 will be defined into which the wall boards 227 may be inserted.

Tie rods 229 are provided in the corner support members and extend in vertical direction through bores 231 of the individual corner support elements. By means of these tie rods 229 the corner support members are fastened in vertical direction.

Each tie rod 229 consists e.g. of a steel rod 231 which is provided with threaded portions 233 on its tie rod ends. Nuts 235 may be threaded onto these threaded portions 233. A washer 237 and a washer 239 may be disposed beneath the nuts 235.

As will be apparent from FIG. 11, vertically extending recesses 241 are formed in the head pieces 219 of the corner support elements. The diameter of these vertically extending recesses is so dimensioned that helical compression springs 243 may be inserted therein. The helical compression springs 243 are seated on the bottom 254 of the recesses 241 and on the washer 239. When the nut 235 in the lower portion of FIG. 11 is tightened, pressure will be applied to the helical compression spring and the corner support member will be fastened in vertical direction. Of course, in that case a nut 235 must also be disposed on the tie rod 229 in the recess 241 in the upper part of FIG. 11. In the embodiment of FIG. 11 a helical compression spring 243 is inserted only into the lower corner support element 201. In the upper corner support element 203, the washer 237 rests on the bottom 245 of the recess 241, and the threaded nut 235 is threaded onto the top threaded portion 233 of the tie rod 229. When the living timber is contracted and expanded, the helical compression spring will compensate for the movements in vertical direction and will always provide for a reliable and secure fastening of the corner support member.

The corner support elements 201 and 203 are so designed that a helical compression spring 243 may also be disposed on the tie rod 229 in the corner support element 203. By providing helical compression springs at either end of the tie rod 229 the fastening and the elasticity of the tie rod may be improved.

A guide sleeve 247 is disposed between the iron core 231 of the tie rod 229 and the helical compression spring 243. The guide sleeve 247 provides for an improved fitting of the helical compression spring 243 in the recess 241. Tilting of the helical compression spring 243 is prevented by means of the sleeve, in particular when the helical compression spring 243 extends to a greater extent from the timber of the corner support element.

I claim:

1. A structural corner support element for a log house or the like which comprises wall boards placed upon each other and forming the walls of the house, and crossed corner support elements stocked upon one another forming the corners of the house, each corner support element consisting of a free-ended, projecting head piece and an inwardly disposed joint member are formed with such a profile that crossing corner support elements define grooves for accomodating inserted wall boards of smaller thickness, the improvement wherein each of said corner support elements comprising a heart quoin, a head piece and a guide strap with complimentary longitudinally extending mortise and tenon profiles on the upper and lower surfaces of each of said head piece and said guide strap, said head piece and said guide strap being equal in height and said heart quoin having a height not greater than half the height of said headpiece, said guide strap having one vertical face contiguous with a first face of said heart quoin and a thickness less than that of said heart quoin, said head piece having one vertical face contiguous with the opposite face of said heart quoin and projecting laterally beyond the first face of said heart quoin, whereby when a plurality of corner support elements are disposed in topwise cogging relationship and crosswise interfitting engagement to form joint assemblies the joint assemblies are in positive interdigitating engagement with joint assemblies disposed thereabove and therebeneath, providing straight slide-in grooves between the head pieces and the guide straps, the guide straps forming an inwardly disposed large-area engagement and abutting surface for the ends of the wall boards.

2. In combination with a structural corner support element as defined in claim 1, an intermediate support member adapted to support building wall boards between the corner support element assemblies which comprises an outer head piece substantially identical in size and shape to said head piece of said corner support element and an inner abutment having the same vertical cross sectional size and shape as that of said head piece, and vertical grooves on each side of said intermediate support member for receiving and retaining said wall boards.

3. In a building structure as claimed in claim 1, a saddleback roof whose rafters are seated on the top sides of the topmost wall boards, characterized by forked props placed in pairs on the inside and the outside onto the upper edges of the topmost wall boards and securing the rafters with their fork prongs.

4. A corner support structure made up of stacked joint assemblies as claimed in claim 1 in which the corner support elements are vertically fastened by means of tie rods provided with a compression spring applying compressive pressure against the topmost and the lowermost corner support element comprising said joint assemblies.

5. A structural element as defined in claim 1 wherein said profiles on said upper and lower surfaces of said head piece comprise a V-shaped profile adjacent an inverted V-shaped profile.

* * * * *